US011480400B2

(12) United States Patent
Bilger

(10) Patent No.: US 11,480,400 B2
(45) Date of Patent: Oct. 25, 2022

(54) GAS PISTON AND WEAPON

(71) Applicant: Rheinmetall Waffe Munition GmbH, Unterlüß (DE)

(72) Inventor: Gerhard Bilger, Unterlüß (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 0 days.

(21) Appl. No.: 17/425,421

(22) PCT Filed: Jan. 8, 2020

(86) PCT No.: PCT/EP2020/050256
§ 371 (c)(1),
(2) Date: Jul. 23, 2021

(87) PCT Pub. No.: WO2020/160859
PCT Pub. Date: Aug. 13, 2020

(65) Prior Publication Data

US 2022/0187037 A1 Jun. 16, 2022

(30) Foreign Application Priority Data

Feb. 4, 2019 (DE) ..... 10 2019 102 660.1

(51) Int. Cl.
*F41A 5/18* (2006.01)
*F41A 5/22* (2006.01)

(52) U.S. Cl.
CPC . *F41A 5/18* (2013.01); *F41A 5/22* (2013.01)

(58) Field of Classification Search
CPC ..... F41A 5/18; F41A 5/20; F41A 5/22; F41A 5/32; F41A 5/34
USPC ..... 89/191.01, 191.02, 192
See application file for complete search history.

(56) References Cited

U.S. PATENT DOCUMENTS 2,451,624 A * 10/1948 Loomis ..... F41A 5/18 89/191.01
3,227,045 A * 1/1966 Kruzell ..... F41A 19/33 89/14.3
4,373,423 A * 2/1983 Moore ..... F41A 5/26 89/193

(Continued)

FOREIGN PATENT DOCUMENTS

DE 3337425 A1 4/1985
DE 3424761 A1 1/1986
DE 60109718 T2 9/2005

OTHER PUBLICATIONS

International Search Report from corresponding PCT Application No. PCT.EP2020/050256, dated Mar. 26, 2020.

*Primary Examiner* — Bret Hayes
(74) *Attorney, Agent, or Firm* — Harness, Dickey & Pierce, P.L.C.

(57) ABSTRACT

The invention relates to a gas piston for a weapon, which is characterized by a spring introduced in the gas piston and a plunger, which engages on one end of the spring, wherein the spring is supported by the other end at the end of the gas piston opposite the plunger. This gas piston can be a component of a gas piston assembly having a counter piston, which is for use in a weapon. The gas piston or the plunger is supported e.g. on the weapon housing. With the special construction of the gas piston or the gas piston assembly formed with same, the gas piston can be transferred from a working position into a resting position within a weapon housing of the weapon.

11 Claims, 4 Drawing Sheets

(56) References Cited

U.S. PATENT DOCUMENTS

| | | | | |
|---|---|---|---|---|
| 5,959,234 | A | 9/1999 | Scaramucci et al. | |
| 2011/0146484 | A1 | 6/2011 | Landies et al. | |
| 2016/0084597 | A1* | 3/2016 | Ricks | F41A 5/28 89/193 |
| 2019/0383572 | A1* | 12/2019 | Gregorich | F41A 15/14 |

* cited by examiner

GAS PISTON AND WEAPON

CROSS-REFERENCE TO RELATED APPLICATIONS

This application is a national phase application of PCT Application No. PCT/EP2020/050256, filed on 8 Jan. 2020, which claims priority to and benefit of German Patent Application No. 10 2019 102 660.1, filed on 4 Feb. 2019. The entire disclosures of the applications identified in this paragraph are incorporated herein by references.

FIELD

The invention relates to a weapon, in particular a self-propelled weapon, such as a gas-powered weapon. Such weapons are also known as automatic cannons. The invention particularly relates to a gas piston return within the weapon.

BACKGROUND

In the case of gas-powered weapons, the unlocking process of closure parts is initiated by one or more gas pistons charged with gas. Such a weapon is disclosed in DE 33 37 425 A1. A device having a longitudinally axially movable transmission member is integrated between the gas piston and the respective spring slide, wherein the impulse from the gas piston is transmitted to the front-side impact surface of the spring slide by means of the transmission member. The transmission member is returned to the end position by a compression spring.

In the case of other gas-powered weapons, after the working stroke of the gas piston(s), the latter remains in any undefined position. The gas piston is then brought into the starting position by parts advancing with the closure parts, for example a closing spring sleeve. This is done by the gas piston recoiling several times. Energy is removed from the advancing closure parts due to the impact and recoil of the gas piston. This loss of energy can prevent the cartridge from igniting.

SUMMARY

FIG. 1 shows a gas piston assembly 1 having an opposing piston 2 and a gas piston 3 according to the prior art. The gas piston assembly 1 is accommodated in a weapon housing 4 of a weapon 5 that is in particular self-propelled. The gas piston 3 engages a closing spring sleeve 6 of a closing spring device (not shown in detail). In practice, two gas piston assemblies 1 and two closing spring sleeves 6 are incorporated, i.e. integrated, in the weapon housing 4. Between these there is a closure, not shown in detail, which is moved from a front to a rear position within the weapon housing. In the front position, the closure is locked with a weapon barrel 8 of the weapon; in the rear position, new ammunition is presented to the closure. This is transported from the closure into a cartridge chamber in the weapon barrel.

When the shot has taken place, gas is fed into the gas piston assembly 1 via a gas extraction hole (not shown in detail) in the weapon barrel 8 and a gas duct 7. As a result, the gas piston 3 is impinged upon by the gas circulating around the gas piston 3. The gas piston 3 presses the closing spring sleeve 6 against the firing direction over a path W in the weapon housing 4. The closing spring sleeve 6 entrains a locking slide in a known manner which carries a locking head (not shown in detail). The locking head is unlocked from the weapon barrel 8 of the weapon 5. When the closing spring sleeve 6 of the closing spring device advances when it brings the bolt carrier or closure forward in the firing direction, the closing spring sleeve 6 strikes the stationary gas piston 3 and strikes it against the opposing piston 2 in the firing direction. Due to the associated dynamic processes, the closing spring sleeve 6 is accelerated in the other direction opposite to the firing direction before the closure has reached the weapon barrel 8. In practice, this process is known as bouncing.

A gas-powered weapon is known from DE 10 2009 056 253 B3. This comprises two closing spring devices on both sides of the closure. A bouncing is prevented by the fact that a driver cam of the one closing spring device is positively and non-positively connected to it, while the connection to the other driver cam has play. As a result, one of the closing spring devices runs onto the gas piston before the other and brakes the following closing spring device by reversing the movement. This prevents bouncing.

DE 10 2009 051 300 A1 suggests integrating a recoil barrier that is located in the recoil path of the locking slide. The recoil barrier comprises a pawl which engages a projection of a closing spring sleeve of a closing spring device which cooperates with the locking slide. As a result, additional masses are drawn along when the locking slide has reached its end stop and recoils in the opposite direction. This suggestion is reversed after a certain time or a certain way. This prevents bouncing. However, such a solution cannot be used with limited installation space.

The object of the invention is therefore, in particular, to exclude bouncing for weapons having a limited installation space.

The task is solved by resetting a gas piston or the gas piston itself. For this purpose, it is provided that a spring and a plunger are built into the gas piston, and that both are integrated in it. After the gas piston has been installed, the plunger is supported on or in the weapon housing.

The gas piston is pushed back by the gas pressure and triggers or initiates the unlocking process of the closure parts. At the same time, the internal spring of the gas piston is compressed by the plunger. After the gas pressure has dropped, the gas piston is pushed back into its starting position by the compressed spring when the spring force is greater than the decreasing gas pressure. The gas piston remains in this end position or in its starting position. This allows the closure parts to move forward unhindered. A bouncing of the closure parts is prevented.

This gas piston can be part of a gas piston assembly having an opposing piston. This gas piston assembly is used in particular in a weapon.

The present invention is thus characterized in that, for example, an unimpeded advance of the closure parts is offered with the use of a few components in a limited installation space.

The gas piston is supplemented by a spring and a plunger. Due to the special construction of the gas piston, the gas piston can now be transferred from a working position to a resting position within the weapon. The special design of the gas piston also enables it to be retrofitted without reworking existing weapons.

A locking ring prevents the plunger from being pressed out of the gas piston if these parts are not installed in the weapon. With this further measure, the gas piston is created as a modular assembly that can be pushed into the weapon housing without any problems. The locking ring can also be used as part of the gas piston assembly. The modular assembly of the gas piston or gas piston assembly requires no reworking and can be installed in existing weapons or exchanged for the old solutions. The gas piston can in turn be designed to be extended if the installation space in the weapon housing requires this. In other words, the gas piston can be extended in order to fill the installation space or the space available in the weapon housing.

BRIEF DESCRIPTION OF THE DRAWINGS

The invention will be explained in more detail with the drawing on the basis of an embodiment.

In the drawings.

DETAILED DESCRIPTION

Figure 1:
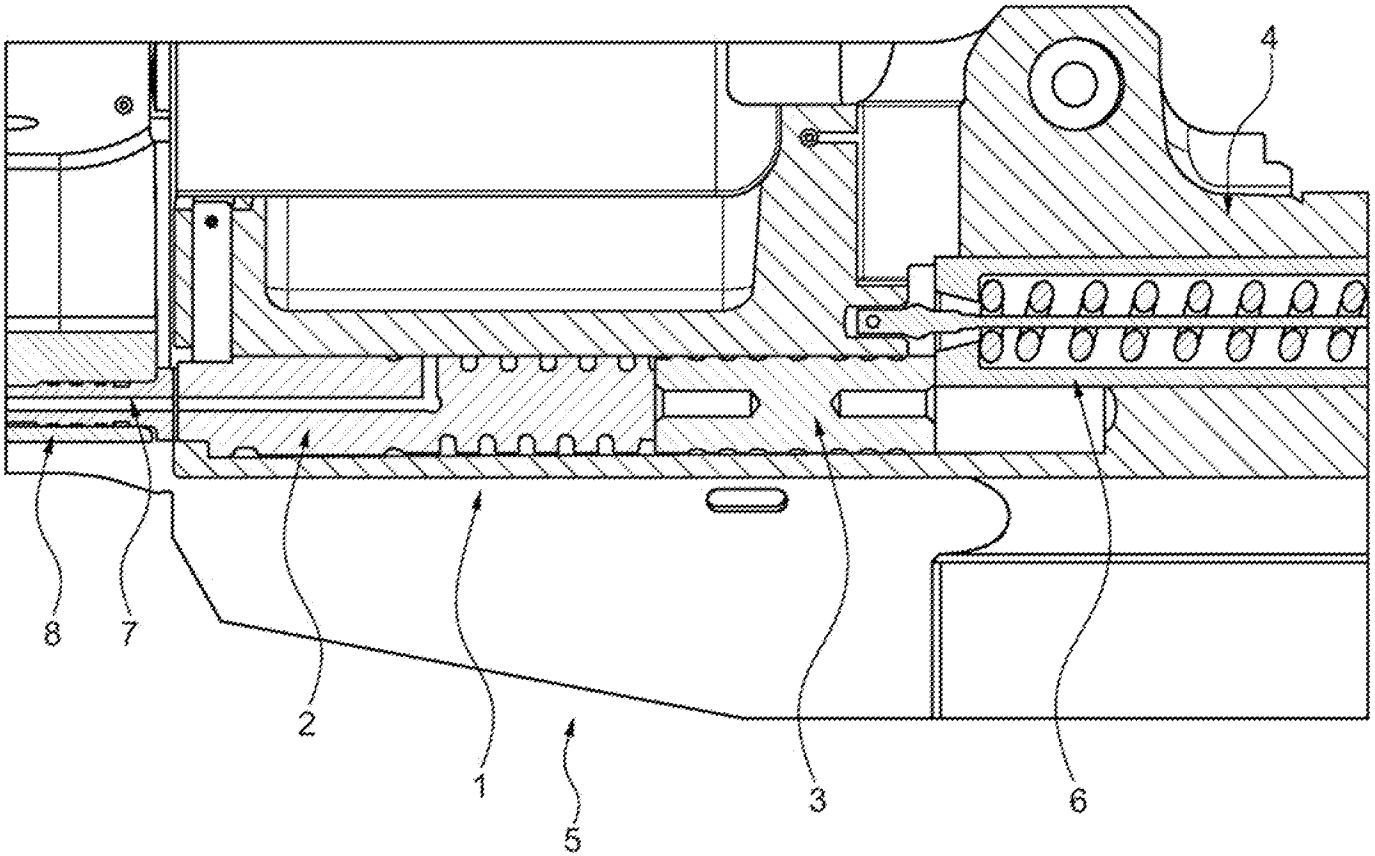
Fig. 1 Prior Art
FIG. 1 shows a gas piston assembly according to the prior art in the installed state.
Figure 2:
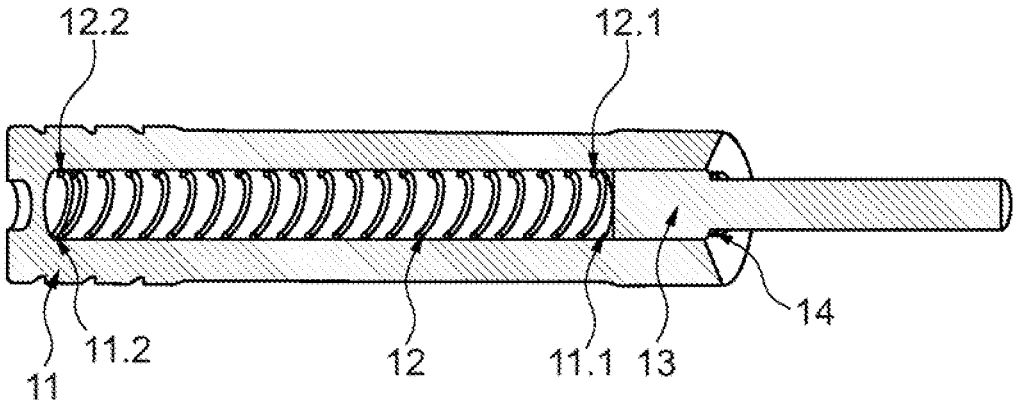
FIG. 2 shows a gas piston according to the invention as a modular assembly.

The present invention (FIG. 2) provides for the use of a gas piston 11 which comprises a spring 12. This can be designed as a compression or helical compression spring. The compression spring 12 is incorporated in the gas piston 11. The gas piston 11 has a plunger 13 at a first end 11.1, which is rearward when viewed in the firing direction. This engages one end 12.1 of the compression spring 12. With the other end 12.2, the compression spring 12 is supported on the housing end 11.2 of the gas piston 11 opposite the plunger 13. A locking ring 14 serves to hold the structure or gas piston 11 together as a modular, unitary assembly.

Figure 3:
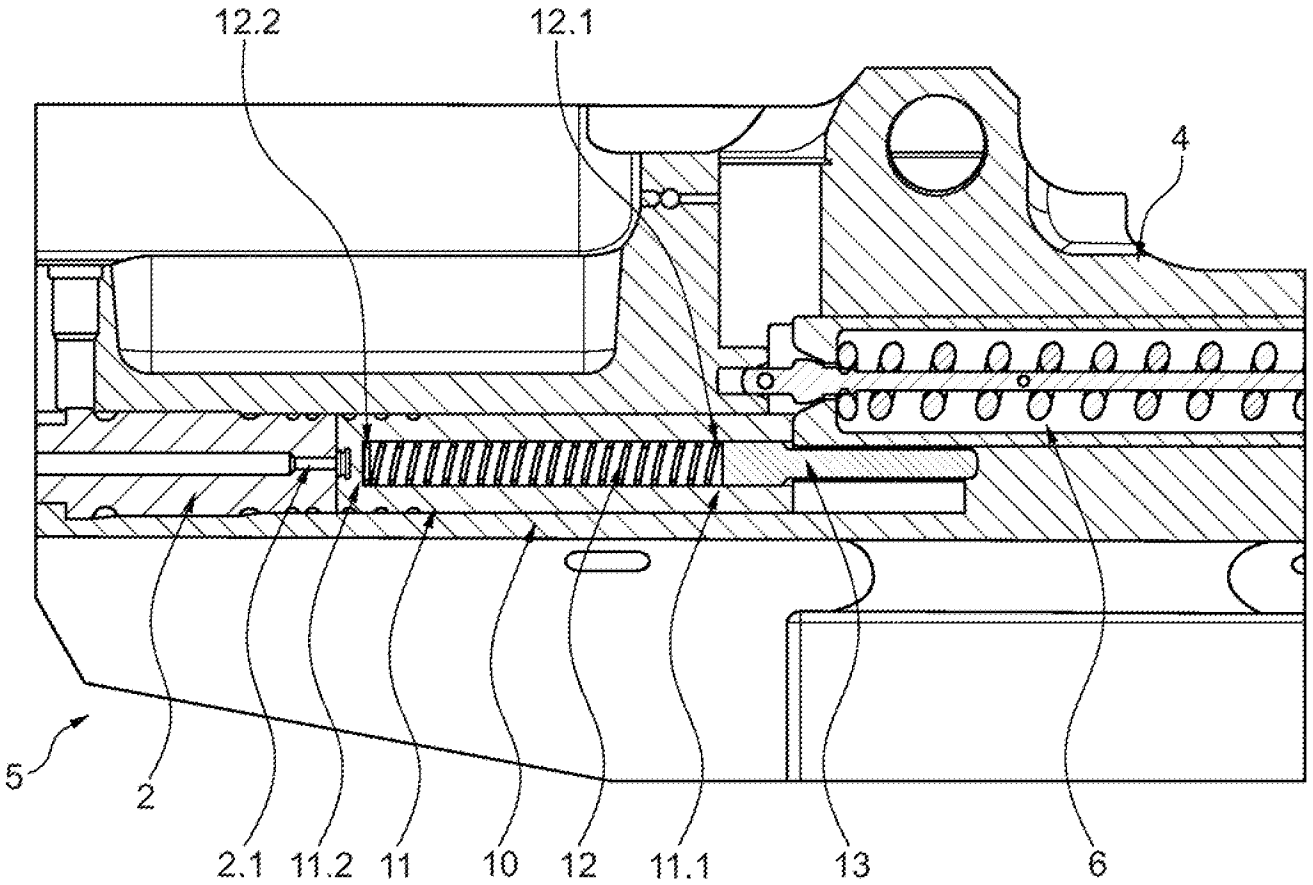
FIG. 3 shows the gas piston from FIG. 2 in the resting state.

FIG. 3 shows a gas piston assembly 10 having the gas piston 11 installed in the weapon housing 4. The gas piston assembly 10 is shown in the resting state. The gas piston assembly 10 comprises the opposing piston 2 and the gas piston 11 having the built-in compression spring 12 and the plunger 13. When extended, the plunger 13 is supported on the weapon housing 4. The rear end 11.1 of the gas piston 11 engages the closing spring sleeve 6 of the weapon 5. A gas bore 2.1 in the opposing piston is directed directly at the gas piston 11. The gas bore 2.1 should preferably be introduced in the opposing piston 2.

Figure 4:
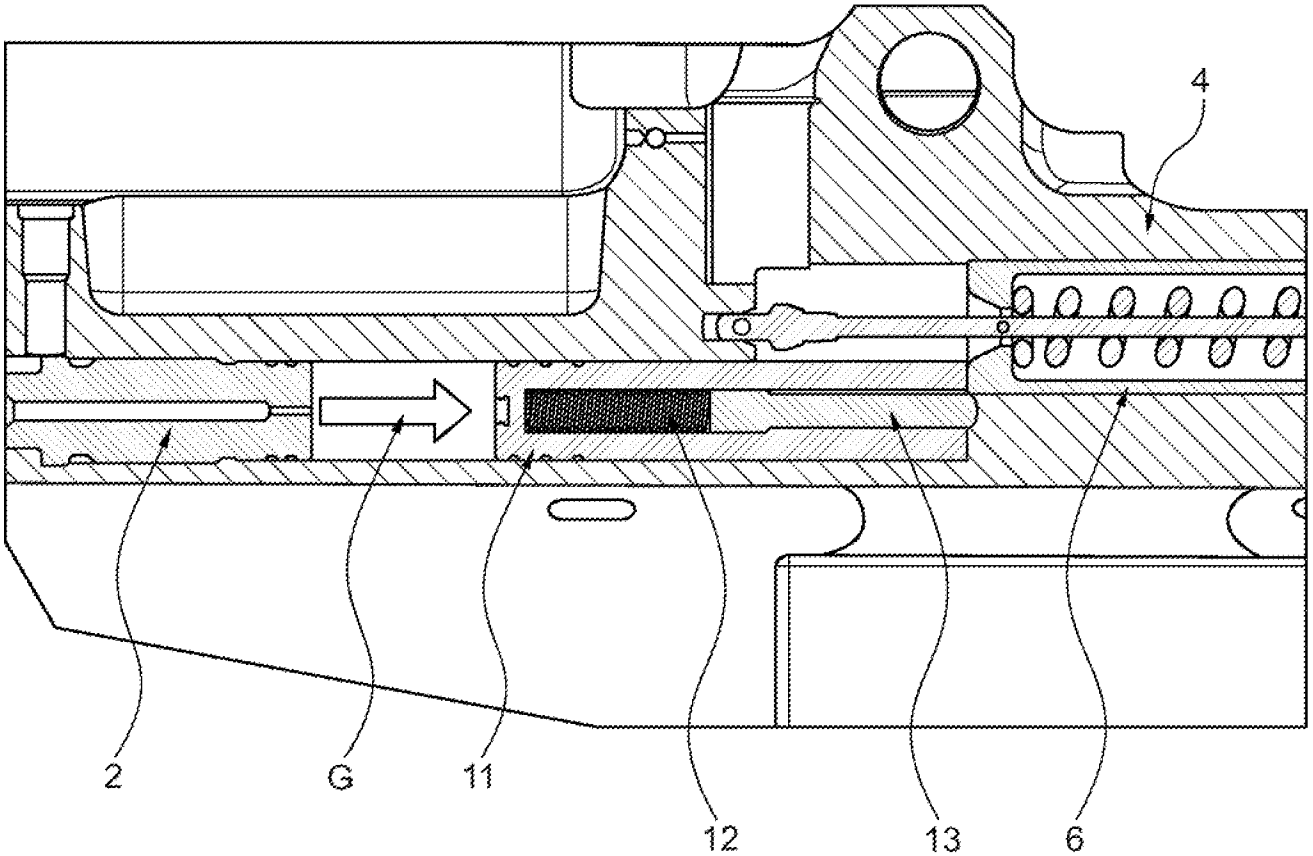
FIG. 4 shows the gas piston from FIG. 2 in the working position.

FIG. 4 shows the gas piston assembly 10 in the working position. The gas produced during the shot is fed to the gas piston 11 via the gas bore 2.1. This gas pressure causes the gas piston 11 to move. This moves the closing spring sleeve 6 against the firing direction. At the same time, the compression spring 12 within the gas piston 11 is compressed and tensioned by the plunger 13. If the gas pressure G falls below a value which is below the pressure of the compression spring 12, the compression spring 12, in cooperation with the plunger 13, which is supported on the weapon housing 4, places the gas piston 11 in its starting position. The closing spring sleeve 6, which rushes forward later in time, can move forward unhindered. Bouncing is avoided.

If closing spring sleeves are provided on both sides of a closure (not shown in detail), two gas pistons or two gas piston assemblies are to be introduced into the weapon housing 4.

However, the use is not limited to a self-propelled weapon if an externally driven weapon uses the gas pressure of the weapon for various weapon functions.

What is claimed is:

1. A gas piston of a weapon, the gas piston comprising:

a housing having a first end, a second end opposing the first end, and a perimeter extending between the first end and the second end and defining a channel;

a spring disposed in the channel of the housing, and supported and compressible against the first end of the housing; and a plunger disposed at least partially in the channel of the housing and engaging one end of the spring, the plunger including a base member positioned between the spring and the second end of the housing and an extension member extending out of the housing at the second end of the housing when the gas piston is in a resting state.

2. The gas piston according to claim 1, further comprising a locking ring coupled to the second end of the housing.

3. The gas piston according to claim 2, wherein the gas piston is a modular assembly.

4. A gas piston assembly of a weapon, the gas piston assembly comprising an opposing piston and the gas piston according to claim 1.

5. A weapon comprising at least one gas piston according to claim 1.

6. The weapon according to claim 5, further comprising a weapon housing, wherein the plunger of the gas piston is supported in the weapon housing.

7. The weapon according to claim 6, further comprising a closing spring sleeve, wherein the plunger of the gas piston is configured to engage the closing spring sleeve.

8. A weapon comprising the gas piston assembly according to claim 4.

9. The weapon according to claim 8, further comprising a weapon housing, wherein the plunger of the gas piston is supported in the weapon housing.

10. The weapon according to claim 9, further comprising a closing spring sleeve, wherein the plunger of the gas piston is configured to engage the closing spring sleeve.

11. The weapon according to claim 6, wherein when a gas pressure on the gas piston is below a spring pressure of the spring, the spring moves the gas piston into its starting position in cooperation with the plunger supported on the weapon housing.

* * * * *